US011753124B2

(12) United States Patent
Srikanta Prasad et al.

(10) Patent No.: US 11,753,124 B2
(45) Date of Patent: Sep. 12, 2023

(54) INFLATABLE TOROIDAL POLYHEDRON BUOYANCY TUBE FOR A LIFE RAFT

(71) Applicant: Goodrich Corporation, Charlotte, NC (US)

(72) Inventors: Guruprasad Srikanta Prasad, Bangalore (IN); Adithya Nagara Venkatachala, Karnataka (IN)

(73) Assignee: GOODRICH CORPORATION, Charlotte, NC (US)

( * ) Notice: Subject to any disclaimer, the term of this patent is extended or adjusted under 35 U.S.C. 154(b) by 338 days.

(21) Appl. No.: 17/143,329

(22) Filed: Jan. 7, 2021

(65) Prior Publication Data

US 2021/0221486 A1 Jul. 22, 2021

(30) Foreign Application Priority Data

Jan. 20, 2020 (IN) ..... 202011002420

(51) Int. Cl.
*B63C 9/04* (2006.01)
*B63B 7/08* (2020.01)

(52) U.S. Cl.
CPC ..... *B63C 9/04* (2013.01); *B63B 7/082* (2013.01); *B63C 2009/042* (2013.01)

(58) Field of Classification Search
CPC ..... B63B 7/08; B63B 7/082; B63B 7/085; B63B 7/087; B63C 9/04; B63C 2009/042; B63C 9/08; B29D 22/02; B29D 22/026; B29D 23/24; B60C 5/00; B60C 5/10
See application file for complete search history.

(56) References Cited

U.S. PATENT DOCUMENTS 3,919,027 A * 11/1975 Jones ..... B29C 53/36 156/203
4,083,070 A 4/1978 Martin
4,472,225 A * 9/1984 Bimpson ..... B63B 7/08 156/218
5,535,697 A * 7/1996 Akahira ..... B63B 7/08 114/345
5,720,234 A 2/1998 Hammer
(Continued)

FOREIGN PATENT DOCUMENTS

DE 2919470 A1 * 11/1980 ..... B63B 7/08
EP 0042582 B1 12/1981
(Continued)

*Primary Examiner* — Ajay Vasudeva
(74) *Attorney, Agent, or Firm* — CANTOR COLBURN LLP

(57) ABSTRACT

Disclosed is a buoyancy tube for a life raft having: a first panel including: a first panel top edge and a first panel bottom edge, the first panel top edge defines a first repeating pattern, and the first panel bottom edge defines a second repeating pattern that is a rotated version of the first panel top edge; a second panel that has a same shape as the first panel, the first and second panels connected by a first elongated seam and a second elongated seam that are non-overlapping with one another, the first and second panels, when connected, define outer an inner boundaries of the life raft, the outer boundary defines an outer polygon having outer sides and the inner boundary defines an inner polygon having inner sides such that each of the plurality of outer sides is parallel with one of the plurality of inner sides.

9 Claims, 9 Drawing Sheets

(56) References Cited

U.S. PATENT DOCUMENTS

| | | | | |
|---|---|---|---|---|
| 6,199,676 | B1 * | 3/2001 | Targiroff | B64D 25/14<br>193/25 B |
| 7,371,445 | B2 | 5/2008 | Keshavaraj | |

FOREIGN PATENT DOCUMENTS

| | | | | | |
|---|---|---|---|---|---|
| FR | 1383033 | A | * | 12/1964 | B63B 7/08 |
| GB | 1224186 | A | | 3/1971 | |
| GB | 2217269 | B | | 10/1989 | |
| JP | 58133989 | A | * | 8/1983 | B63B 7/08 |
| JP | 58133990 | A | * | 8/1983 | B63B 7/08 |

* cited by examiner

INFLATABLE TOROIDAL POLYHEDRON BUOYANCY TUBE FOR A LIFE RAFT

CROSS-REFERENCE TO RELATED APPLICATIONS

This application claims the benefit of IN Application No. 202011002420, filed Jan. 20, 2020, the disclosure of which is incorporated herein by reference in its entirety.

BACKGROUND

The embodiments herein relate to life rafts and more specifically to an inflatable toroidal polyhedron buoyancy tube for a life raft, and a method of configuring the same.

Inflatable rafts which can be compacted into extremely small packages have found considerable acceptance for utilization as life saving devices during emergencies. Theses rafts are designed so that they include a passenger receptacle and are formed with one or more inflatable chambers provided in the walls of the raft which are inflated for use. Such life rafts have been inflatable either through oral exhalation of the passenger into a mouthpiece valve or inflated using pressurized gas cartridges which expel its contents in the inflatable chambers, upon demand. Such life rafts are ideally relatively simple in design to be relatively easily mass produced.

BRIEF SUMMARY

Disclosed is a buoyancy tube for a life raft comprising: a first panel including: a first panel top edge; a first panel bottom edge spaced apart the first panel top edge such that a first panel transverse axis is defined between the first panel top edge and the first panel bottom edge, wherein the first panel top edge defines a first repeating pattern, and the first panel bottom edge defines a second repeating pattern that is a rotated version of the first panel top edge about a first panel rotational axis; a first panel tip edge; and a first panel tail edge apart from first panel tip edge such that a first panel longitudinal axis perpendicular to the first panel transverse axis is defined between the first panel tip edge and the first panel tail edge; a second panel that has a same shape as the first panel, whereby the second panel includes: a second panel top edge; a second panel bottom edge; a second panel tip edge; and a second panel tail edge, wherein the first panel and the second panel are connected by a first elongated seam and a second elongated seam that are non-overlapping with one another, wherein the first elongated seam connects the first panel bottom edge and the second panel top edge, from the first panel tip edge to the first panel tail edge, and the second elongated seam connects the first panel top edge and the second panel bottom edge, from the first panel tip edge to the first panel tail edge, and wherein the first panel and second panel, when connected, define outer an inner boundaries of the life raft, the outer boundary defines an outer polygon having a plurality of outer sides and the inner boundary defining an inner polygon having a plurality of inner sides such that each of the plurality of outer sides is parallel with one of the plurality of inner sides.

In addition to one or more of the above disclosed aspects or as an alternate, the plurality of outer sides includes a first outer side extending from a first end to a second end; the plurality of inner sides includes a first inner side extending from a third end to a fourth end, wherein the first outer side and the first inner side are parallel to one another; the plurality of inner sides includes a second inner side that extends from a fifth end to the third end, wherein the second inner side is circumferentially adjacent to the first inner side; a first seam portion of a first elongated seam extends from the first end to the fifth end, between the outer polygon and the inner polygon; a second seam portion of a second elongated seam extends from the second end to the third end, between the outer polygon and the inner polygon; and the first elongated seam and the second elongated seam extend a plurality of times around the life raft.

In addition to one or more of the above disclosed aspects or as an alternate a first leg of a quadrilateral is defined by the first outer side; a second leg of the quadrilateral is defined by the first elongated seam portion; and a third leg of the quadrilateral is defined by a second elongated seam portion; and a fourth leg of the quadrilateral is defined by the second inner side.

In addition to one or more of the above disclosed aspects or as an alternate the quadrilateral defines a first normal axis extending from the third end through a point on the first leg of the quadrilateral, wherein the first normal axis is normal to the first leg of the quadrilateral; a normal axis segment extends along the first normal axis, between the third end and the point on the first leg of the quadrilateral; a second normal axis is normal to the first normal axis and extends from the third end; and an obtuse angle is defined between the second normal axis and the fourth leg of the quadrilateral.

In addition to one or more of the above disclosed aspects or as an alternate the plurality of outer sides and the plurality of inner sides each comprise (n) sides; a length of the first normal axis segment is $(Do-Di)\times n/4$, wherein (Do) is a diameter formed by outer edges of the outer polygon, and (Di) is a diameter formed by outer edges of the inner polygon; the obtuse angle is $(180-(360/n))$, measured in degrees; a length of the first leg of the quadrilateral is $Do*\sin(360/(2n))$; and a length of the fourth leg of the quadrilateral, defined by the second inner side of the plurality of inner sides, is $Di*\sin(360/(2n))$.

In addition to one or more of the above disclosed aspects or as an alternate the second leg and the third leg of the quadrilateral formed by the second seam portion are each formed along a curve defined by $y=Ax^2+0.8x$.

In addition to one or more of the above disclosed aspects or as an alternate the first panel includes a first plurality of segments, wherein each of the first plurality of segments has a same shape as one another; and the first plurality of segments are connected in series.

In addition to one or more of the above disclosed aspects or as an alternate a first segment of the first plurality of segments includes a first segment tip edge, a first segment tail edge, a first segment top edge and a first segment bottom edge; the first segment is divided by a first segment linear joint extending between the first segment top edge and the first segment bottom edge, defining into a first segment tip portion and a first segment tail portion; the first segment tip portion includes: the first segment tip edge; a first segment tip portion top edge; and a first segment tip portion bottom edge; the first segment tail portion includes: the first segment tail edge; a first segment tail portion top edge; and a first segment tail portion bottom edge; the first segment tip portion is a rotated version of the first segment tail portion about a first segment rotation axis; and the first leg of the quadrilateral is formed along the first segment linear joint; the second leg of the quadrilateral is formed along the first segment tail portion bottom edge; the third leg of the quadrilateral is formed by the first segment tail portion top edge and the fourth leg of the quadrilateral is formed by the first panel tail edge.

Further disclosed is a method of forming a buoyancy tube for a life raft comprising: forming a first panel wherein a first panel top edge defines a first repeating pattern, and wherein a second repeating pattern in a first panel bottom edge is defined by rotating the first panel top edge about a first panel rotational axis; forming a second panel, wherein the first panel and the second panel have a same shape as one another; and connecting the first panel and the second panel by two elongated seams, wherein one of the two elongated seams connects the first panel bottom edge and a second panel top edge from a first panel tip edge to a first panel tail edge, and another of the two elongated seams connects the first panel top edge and a second panel bottom edge from the first panel tip edge to the first panel tail edge.

Further disclosed is a buoyancy tube for a life raft comprising: a first panel including: a first panel top edge; a first panel bottom edge spaced apart the first panel top edge such that a first panel transverse axis is defined between the first panel top edge and the first panel bottom edge, wherein the first panel top edge defines a first repeating pattern, and the first panel bottom edge defines a second repeating pattern that is a rotated version of the first panel top edge about a first panel rotational axis; a first panel tip edge; and a first panel tail edge apart from first panel tip edge such that a first panel longitudinal axis perpendicular to the first panel transverse axis is defined between the first panel tip edge and the first panel tail edge, wherein the first panel is welded upon itself with the a first elongated seam and a second elongated seam that are non-overlapping with one another, wherein the first elongated seam connects the first panel bottom edge, adjacent to the first panel tail edge, with the first panel top edge, intermediate of the first panel tail edge and the first panel tip edge, and extends continuously to the first panel tip edge, and the second elongated seam connects the first panel top edge, adjacent to the first panel tail edge, with the first panel bottom edge, intermediate of the first panel tail edge and the first panel tip edge, and extends continuously to the first panel tip edge, and wherein the first elongated seam and second elongated seam, when connected, define outer and inner boundaries of the life raft, the outer boundary defines an outer polygon having a plurality of outer sides and the inner boundary defining an inner polygon having a plurality of inner sides such that each of the plurality of outer sides is parallel with one of the plurality of inner sides.

In addition to one or more of the above disclosed aspects or as an alternate the plurality of outer sides includes a first outer side extending from a first end to a second end; the plurality of inner sides includes a first inner side extending from a third end to a fourth end, wherein the first outer side and the first inner side are parallel to one another; the plurality of inner sides includes a second inner side that extends from a fifth end to the third end, wherein the second inner side is circumferentially adjacent to the first inner side; a first seam portion of a first elongated seam extends from the first end to the fifth end, between the outer polygon and the inner polygon; a second seam portion of a second elongated seam extends from the second end to the third end, between the outer polygon and the inner polygon; and the first elongated seam and the second elongated seam extend a plurality of times around the life raft.

In addition to one or more of the above disclosed aspects or as an alternate a first leg of a quadrilateral is defined by the first outer side; a second leg of the quadrilateral is defined by the first elongated seam portion; a third leg of the quadrilateral is defined by a second elongated seam portion; and a fourth leg of the quadrilateral is defined by the second inner side.

In addition to one or more of the above disclosed aspects or as an alternate the quadrilateral defines a first normal axis extending from the third end through a point on the first leg of the quadrilateral, wherein the first normal axis is normal to the first leg of the quadrilateral; a normal axis segment extends along the first normal axis, between the third end and the point on the first leg of the quadrilateral; a second normal axis is normal to the first normal axis and extends from the third end; and an obtuse angle is defined between the second normal axis and the third leg of the quadrilateral.

In addition to one or more of the above disclosed aspects or as an alternate the plurality of outer sides and the plurality of inner sides each comprise (n) sides; a length of the first normal axis segment is $(Do-Di)\times n/4$, wherein (Do) is a diameter formed by outer edges of the outer polygon, and (Di) is a diameter formed by outer edges of the inner polygon; the obtuse angle is $(180-(360/n))$, measured in degrees; a length of the first leg of the quadrilateral is $Do*\sin(360/(2n))$; and a length of the fourth leg of the quadrilateral, defined by the second inner side of the plurality of inner sides, is $Di*\sin(360/(2n))$.

In addition to one or more of the above disclosed aspects or as an alternate the second leg and the third leg of the quadrilateral formed by the second seam portion are each formed along a curve defined by $y=Ax\hat{}2+0.8x$.

In addition to one or more of the above disclosed aspects or as an alternate the first panel includes a first plurality of segments, wherein each of the first plurality of segments has a same shape as one another; and the first plurality of segments are connected in series.

In addition to one or more of the above disclosed aspects or as an alternate a first segment of the first plurality of segments includes a first segment tip edge, a first segment tail edge, a first segment top edge and a first segment bottom edge; the first segment is divided by a first segment linear joint extending between the first segment top edge and the first segment bottom edge, defining into a first segment tip portion and a first segment tail portion; the first segment tip portion includes: the first segment tip edge; a first segment tip portion top edge; and a first segment tip portion bottom edge; the first segment tail portion includes: the first segment tail edge; a first segment tail portion top edge; and a first segment tail portion bottom edge; the first segment tip portion is a rotated version of the first segment tail portion about a first segment rotation axis; and the first leg of the quadrilateral is formed along the first segment linear joint; the second leg of the quadrilateral is formed along the first segment tail portion bottom edge; the third leg of the quadrilateral is formed by the first segment tail portion top edge and the fourth leg of the quadrilateral is formed by the first panel tail edge.

In addition to one or more of the above disclosed aspects or as an alternate the first elongated seam connects the first segment tail portion bottom edge with an intermediate segment tail portion top edge, wherein the first elongated seam extends along the first panel top edge until an intermediate segment tip portion bottom edge connects with a tip segment tip portion top edge; and the second elongated seam connects the first segment tail portion top edge with a tip-adjacent segment tail portion bottom edge, and wherein the second elongated seam extends along the first panel top edge until connecting a tail-adjacent segment tip portion top edge with a tip segment tip portion bottom edge.

Further disclosed is a method of forming a buoyancy tube for a life raft comprising: forming a first panel wherein a first panel top edge defines a first repeating pattern, and wherein a second repeating pattern in a first panel bottom edge is defined by rotating the first panel top edge about a first panel rotational axis; welding the first panel upon itself with two elongated seams, wherein a first elongated seam of the two elongated seams connects the first panel bottom edge, adjacent to a first panel tail edge, with the first panel top edge, intermediate of the first panel tail edge and a first panel tip edge, and the first elongated seam extends continuously between the first panel top edge and the first panel bottom edge to the first panel tip edge; and a second elongated seam of the two elongated seams connects the first panel top edge, adjacent to the first panel tail edge, with the first panel bottom edge, intermediate of the first panel tail edge and the first panel tip edge, and the second elongated seam extends continuously between the first panel top edge and the first panel bottom edge to the first panel tip edge.

In addition to one or more of the above disclosed aspects or as an alternate the first elongated seam connects a first segment tail portion bottom edge with an intermediate segment tail portion top edge, wherein the first elongated seam extends along the first panel top edge until an intermediate segment tip portion bottom edge connects with a tip segment tip portion top edge; and the second elongated seam connects a first segment tail portion top edge with a tip-adjacent segment tail portion bottom edge, and wherein the second elongated seam extends along the first panel top edge until connecting a tail-adjacent segment tip portion top edge with a tip segment tip portion bottom edge.

BRIEF DESCRIPTION OF THE DRAWINGS

The present disclosure is illustrated by way of example and not limited in the accompanying figures in which like reference numerals indicate similar elements.

DETAILED DESCRIPTION

A detailed description of one or more embodiments of the disclosed apparatus and method are presented herein by way of exemplification and not limitation with reference to the Figures.

The construction of a life raft toroidal polyhedron buoyancy tube typically consists of multiple discrete coated fabric panels which are to be joined to each other with a butt/lap seam construction and the final tube seam shall be closed in order to achieve the required shape. The process involves several practical limitations, e.g.: joining of multiple discrete seams takes a long time; multiple seam intersections/crossover seams create additional leak paths; fabric patterns with concave-to-concave and convex-to-convex seam joining leads to seam pulling, which creates a difficulty in seam alignment, leading to lower production rates and manufacturing difficulties; designs that are unable to produce long uninterrupted seams that are appropriate for continuous heat sealing; less opportunities to automate a complete tube formation process because of the utilization of multiple patterns and alignment difficulties; and low pattern nesting efficiencies due to the shape of the panels.

To overcome the above limitations, disclosed herein is an inflatable toroidal polyhedron buoyancy tube for a life raft designed to facilitate a continuous seam joining process without a seam cross-over.

Figure 1:
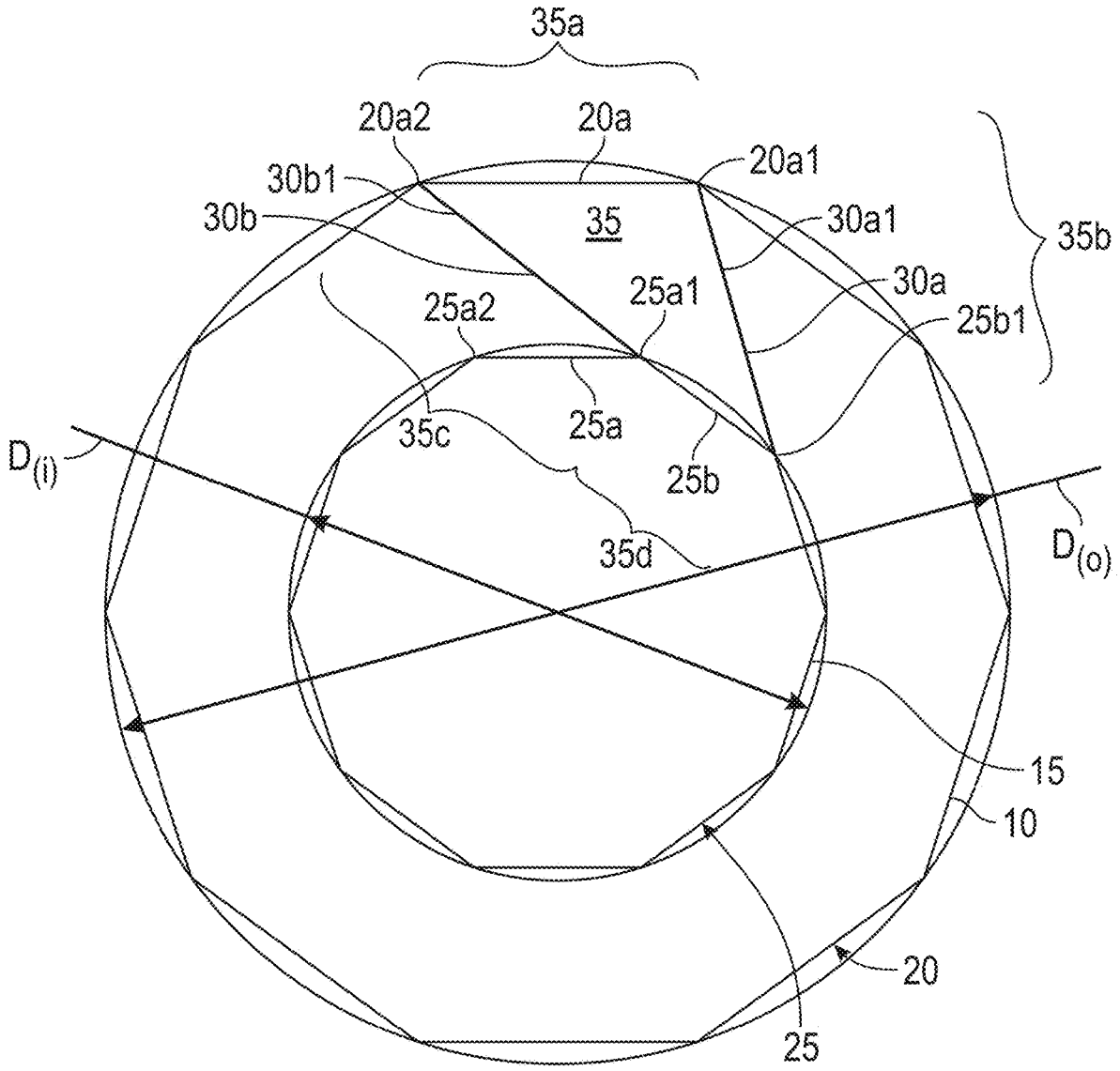
FIG. 1 shows a buoyancy tube for a life raft according to an embodiment.

Turning to FIG. 1, an inflatable toroidal polyhedron tube life raft (life raft 5) is illustrated according to an embodiment. FIG. 1 illustrates the life raft 5, e.g., when deflated and lying flat. The life raft 5 defines an outer polygon 10, wherein outer tips of the outer polygon 10 define an outer diameter curve such as a circle having an outer dimeter D(o). The life raft defines an inner polygon 15, wherein outer tips of the inner polygon 15 define an inner dimeter curve such as a circle having an inner diameter D(i).

The outer polygon 10 has a plurality of outer sides 20. According to an embodiment each of the plurality of outer sides 20 has a same length as one another. The inner polygon has plurality of inner sides 25. According to an embodiment each of the plurality of inner sides 25 has a same length as one another. The life raft 5 is formed such that for each one of the plurality of outer sides 20, a corresponding one of the plurality of inner sides 25 is parallel thereto. According to a disclosed embodiment there are a same number (n) of the plurality of outer sides 20 as the plurality of inner sides 25.

According to an embodiment the plurality of outer sides 20 includes a first outer side 20*a* extending from a first end 20*a*1 to a second end 20*a*2. The plurality of inner sides 25 includes a first inner side 25*a* extending from a third end 25*a*1 to a fourth end 25*a*2. The first outer side 20*a* and the first inner side 25*a* are parallel to one another. The plurality of inner sides 25 also includes a second inner side 25*b* that extends from a fifth end 25*b*1 to the third end 25*a*1. The second inner side 25*b* is circumferentially adjacent to the first inner side 25*a*.

Fabric forming the life raft 5 is welded such that a first seam portion 30*a*1 of a first elongated seam 30*a* extends from the first end 20*a*1 to the fifth end 25*b*1, between the outer polygon 10 and the inner polygon 15. A second elongated seam portion 30*b*1 of a second elongated seam 30*b* extends from the second end 20*a*2 to the third end 25*a*1, between the outer polygon 10 and the inner polygon 15. Both the first elongated seam 30*a* and the second elongated seam 30*b* wrap a plurality of times around the life raft 5, as will be disclosed in greater detail below.

A quadrilateral 35 is formed by the fabric on a surface of the life raft 5. The quadrilateral 35 has a first leg 35*a* defined by the first outer side 20*a*, a second leg 35*b* defined by the first seam portion 30*a*1, a third leg 35*c* defined by the second elongated seam portion 30*b*1 and the fourth leg 35*d* defined by the second inner side 25*b*.

Figure 2:
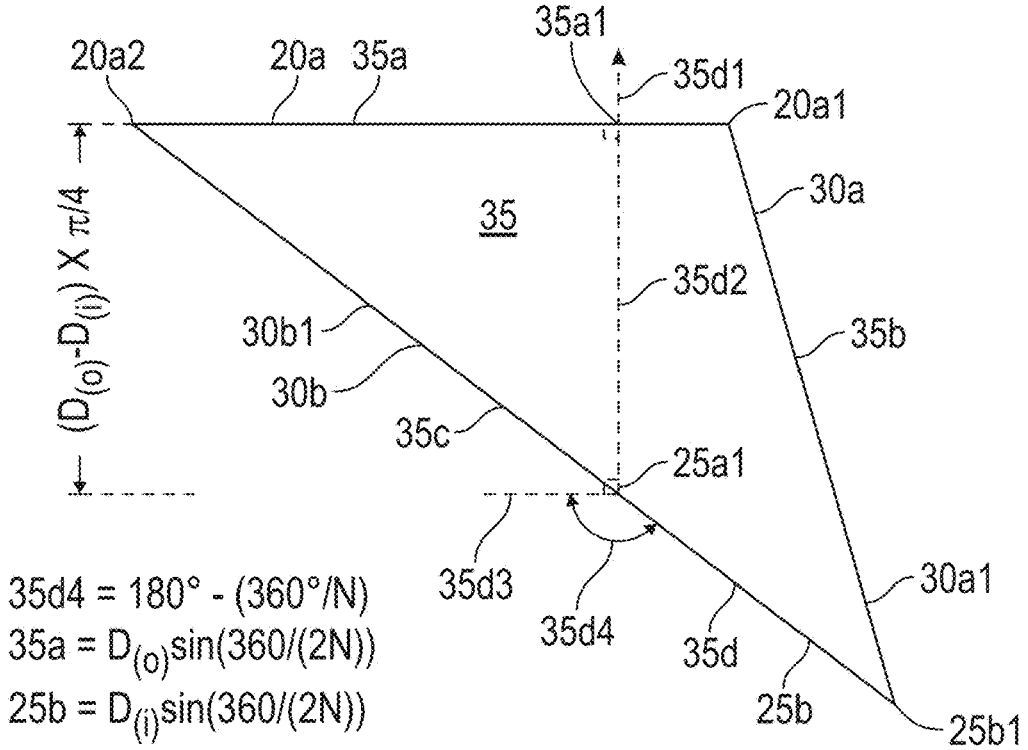
FIGS. 2-3 shows additional geometric details of the buoyancy tube for a life raft according to an embodiment.

Turing to FIG. 2, additional aspects of the quadrilateral 35 are shown. FIG. 2 shows the first leg 35*a* of the quadrilateral 35, defined by the first outer side 20*a*, between the first end 20*a*1 and the second end 20*a*2. FIG. 2 also shows the second leg 35*b* of the quadrilateral 35, defined by the first seam portion 30*a*1 of the first elongated seam 30*a*, extending between the first end 20*a*1 and the fifth end 25*b*1. FIG. 2 also shows the third leg 35*c* of the quadrilateral 35, defined by the second elongated seam portion 30*b*1, extending from the second end 20*a*2 and the third end 25*a*1 and the fourth leg of the quadrilateral defined by the second inner side 25*b*, extending from the third end 25*a*1 to the fifth end 25*b*1.

The quadrilateral 35 defines a first normal (perpendicular) axis 35*d*1 extending from the third end 25*a*1 through a point 35*a*1 on the first leg 35*a* of the quadrilateral 35. The first normal axis 35*d*1 is normal to the first leg 35*a* of the quadrilateral 35. A normal axis segment 35*d*2 extends along the first normal axis 35*d*1, between the third end 25*a*1 and the point 35*a*1 on the first leg 35*a* of the quadrilateral 35. A second normal axis 35*d*3 is normal to first normal axis 35*d*1 and extends from the third end 25*a*1, in a direction that leads away from the quadrilateral 35. An obtuse angle 35*d*4 is defined between the second normal axis 35*d*3 and the third leg 35*c* of the quadrilateral 35. The angle 35*d*4 is derived from the equation: 35*d*4=180°−(360°/n). Where n in the number of sides of the polygon ("life raft geometry").

A length of the normal axis segment 35*d*2 is (Do−Di)−n/4, where (Do) and (Di) are identified above. A length of the first leg 35*a* of the quadrilateral 35 is Do*sin(360/(2n)). A length of the fourth leg 35*d* of the quadrilateral 35, defined by the second inner side 25*b* of the plurality of inner sides 25, is Di*sin(360/(2n)).

Figure 3:
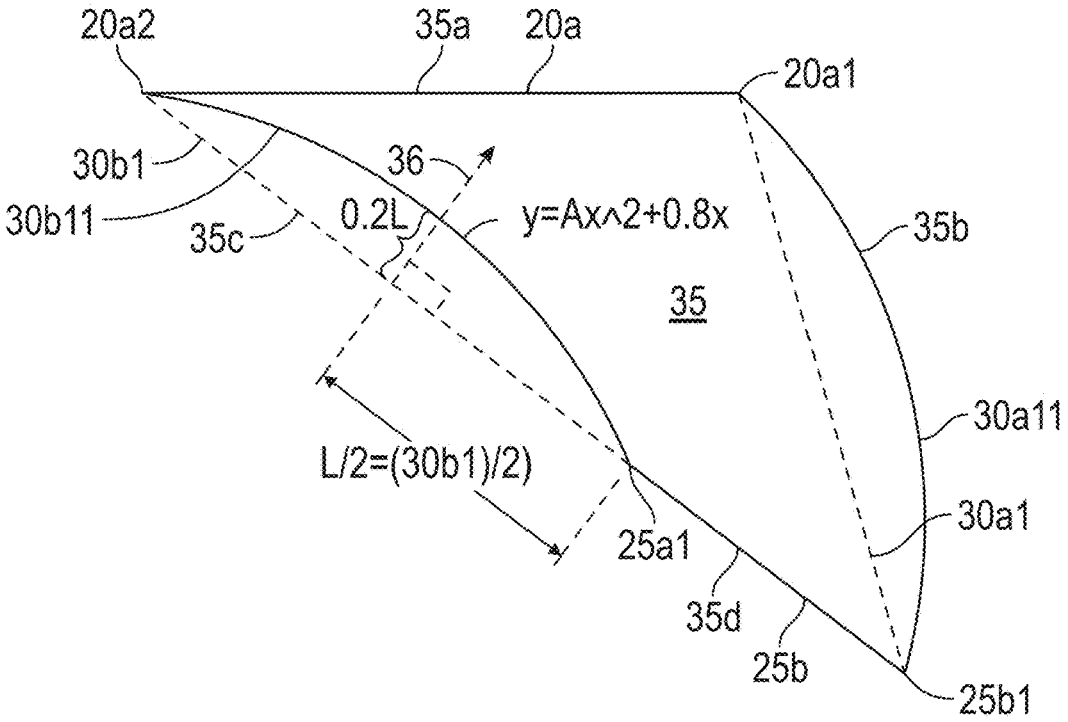

Turning to FIG. 3, the figure illustrates additional features of the quadrilateral 35. The first leg 35*a* and the portion of the quadrilateral formed by the second inner side 25*b* are the same as illustrated in FIG. 2. The second leg 35*b* of the quadrilateral 35 and the third leg 35*c* of the quadrilateral 35 formed by the second elongated seam portion 30*b*1 are both formed along a toroidal curve defined by y=Ax^2+0.8x. The curve forms a curved first seam portion 30*a*11 that extends between the first end 20*a*1 and the fifth end 25*b*1. The curve forms a curved second seam portion 30*b*11 that extends between the second end 20*a*2 and the third end 25*a*1. Based on this formula, for example, a maximum offset between the second elongated seam portion 30*b*1 and the curved second seam portion 30*b*11 is 0.2*L, where L/2=(30*b*1)/2, or half a length between the second end 20*a*2 and the third end 25*a*1. For reference, the maximum offset is measured along a perpendicular bisector 36 of the portion of the third leg 35*c* of the quadrilateral 35 along the second elongated seam portion 30*b*1.

Figure 4:
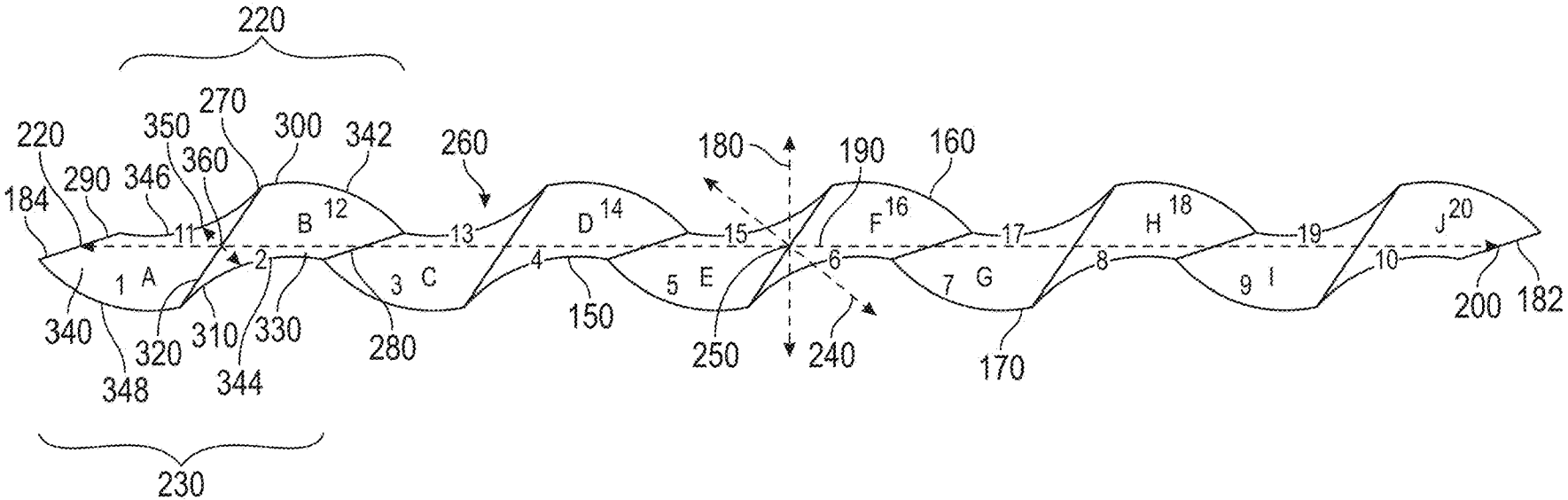
FIG. 4 shows a first panel utilized to form the buoyancy tube for a life raft according to an embodiment.

Turning to FIG. 4, the life raft 5 having the features identified above is formed by a first panel 150. The first panel 150 includes a first panel top edge 160 and a first panel bottom edge 170 that are spaced apart from one another along a first panel transverse axis 180, e.g., that extends along a first panel transverse direction. A first panel tip edge 182 and a first panel tail edge 184 are spaced apart from one another along a first panel longitudinal axis 190, e.g., that extends in a first panel longitudinal direction. More specifically, the first panel longitudinal axis 190 extends between a first panel tip midpoint 200 that bisects the first panel tip edge 182 and a first panel tail midpoint 220 that bisects the first panel tail edge 184.

The first panel top edge 160, end to end, is non-linear and defines a first repeating pattern 220. The first panel bottom edge 170, end to end, is non-linear and defines a second repeating pattern 230. According to an embodiment, the first panel bottom edge 170 is defined by the first panel top edge 160, rotated (e.g., providing a rotated version) about a first panel rotational axis 240. The first panel rotational axis 240 extends perpendicularly to both the first panel longitudinal axis 190 and the first panel transverse axis 180. The first panel rotational axis 240 extends through a first panel longitudinal midpoint 250 located between the first panel tip midpoint 200 and the first panel tail midpoint 220.

In addition and according to an embodiment the first panel 150 includes a first plurality of segments 260 including, for example, a first segment 270. Each of the first plurality of segments 260 has a same shape as one another. The first plurality of segments 260 are connected in series. The first segment 270 includes a first segment tip edge 280, a first segment tail edge 290, a first segment top edge 300 that defines the first repeating pattern 220 and a first segment bottom edge 310 that defines the second repeating pattern 230. The first segment 270 is divided by a first segment linear joint 320 extending between the first segment top edge 300 and the first segment bottom edge 310 to define a first segment tip portion 330 and a first segment tail portion 340. The first segment tip portion 330 includes the first segment tip edge 280, a first segment tip portion top edge 342, and a first segment tip portion bottom edge 344. The first segment tail portion 340 includes the first segment tail edge 290, a first segment tail portion top edge 346, and a first segment tail portion bottom edge 348.

According to an embodiment the first segment tip portion 330 is defined by rotating the first segment tail portion 340 about a first segment rotation axis 350. The first segment rotation axis 350 is parallel to the first panel rotational axis 240 and extends from a midpoint 360 of the first segment linear joint 320.

By comparing FIGS. 3-4, it can be appreciated that the first segment tail portion 340 forms the quadrilateral 35. That is, the first leg 35*a* of the quadrilateral 35 (FIG. 3), which is also the first outer side 20*a* (FIG. 1) is formed along the first segment linear joint 320 (FIG. 4). The second leg 35*b* of the quadrilateral 35, which defines the curved first seam portion 30*a*11 (FIG. 3), is formed along the first segment tail portion bottom edge 348 (FIG. 4). The fourth leg 35*d* of the quadrilateral 35 formed along the second inner side 25*b* (FIG. 3) is formed by the first panel tail edge 184 (FIG. 4). The third leg 35*c* of the quadrilateral 35 which defines the curved second seam portion 30*b*11 (FIG. 3) is formed along the first segment tail portion top edge 346.

Figure 5:
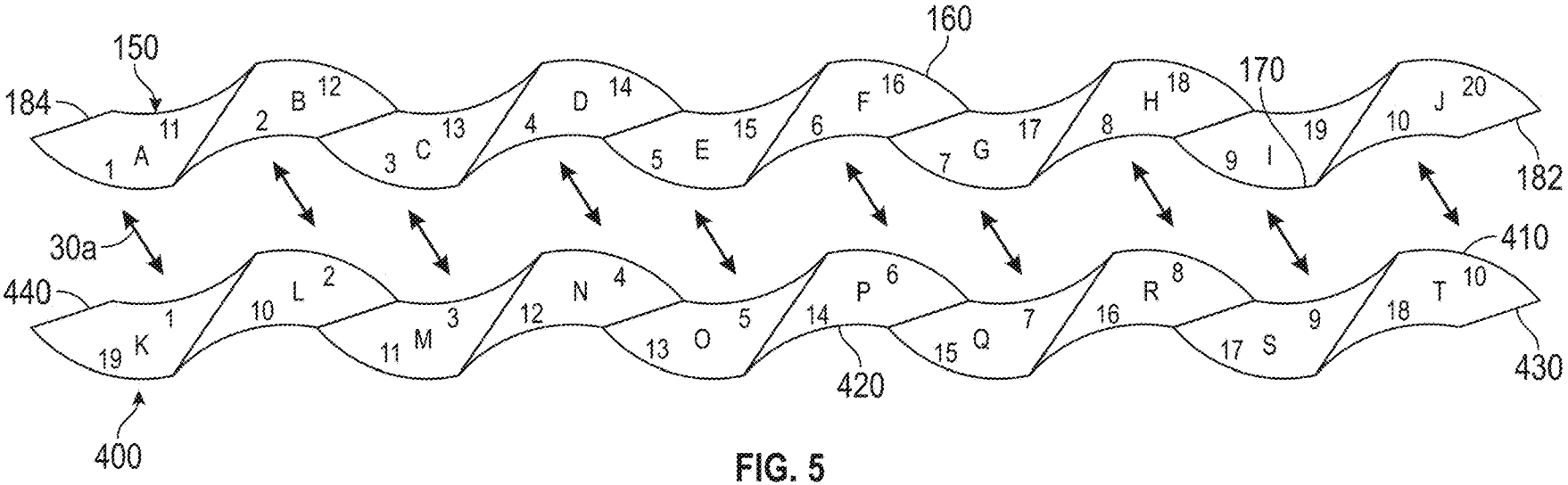
FIGS. 5-6 show details of connecting edges of a first panel with a second panel to form the buoyancy tube for a life raft according to an embodiment.

Turning to FIG. 5, according to an embodiment (n) is an even number, such as ten (10) and (n/2) segments are formed in the first panel 150, where the first panel 150 has the same features of the first panel 150 disclosed above. The life raft 5 (FIG. 1) is formed by the first panel 150 connected with a second panel 400. The first panel 150 and the second panel have a same shape as one another. Thus the second panel includes a second panel top edge 410 and a second panel bottom edge 420, a second panel tip edge 430 and a second panel tail edge 440.

Figure 6:
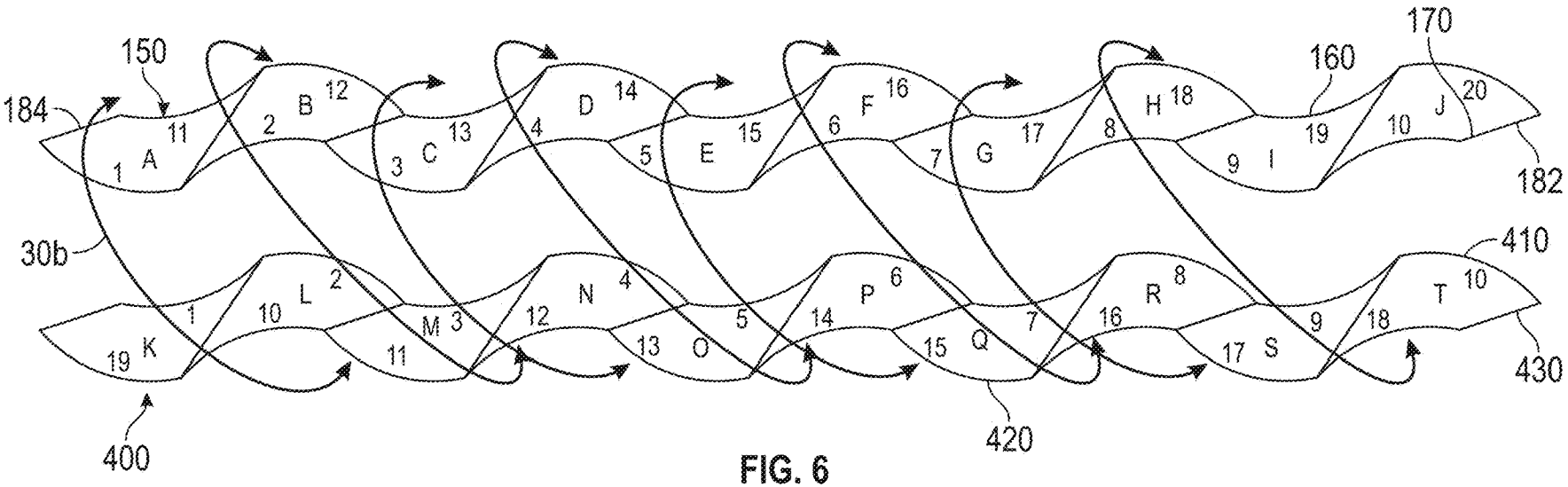

As illustrated in FIGS. 5 and 6, the first panel 150 and the second panel are connected by the two elongated seams that are non-overlapping with one another. The two elongated seams include the first elongated seam 30*a* (illustrated schematically in FIG. 5) and the second elongated seam 30*b* (illustrated schematically in FIG. 6). The elongated seams 30*a*, 30*b* are formed, e.g., by welding. The first elongated seam 30*a* connects the first panel bottom edge 170 and the second panel top edge 410 from the first panel tip edge 182 to the first panel tail edge 184. The second elongated seam

30*b* connects the first panel top edge 160 and the second panel bottom edge 420 from the first panel tip edge 182 to the first panel tail edge 184.

Figure 7:
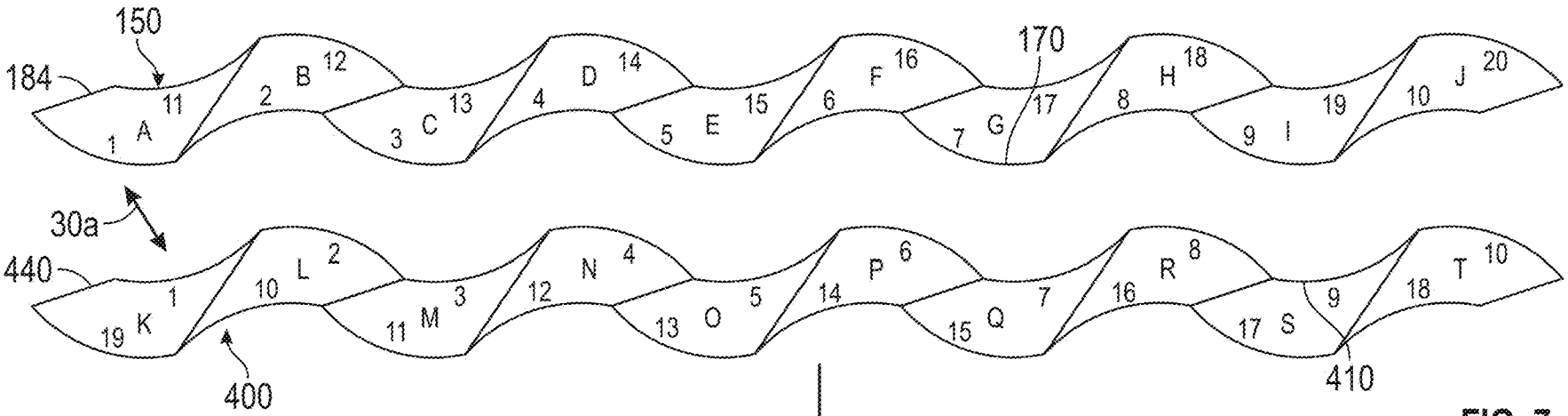
FIGS. 7-10 show additional details of connecting edges of the first panel with the second panel to form the buoyancy tube for a life raft according to an embodiment.
Figure 8:
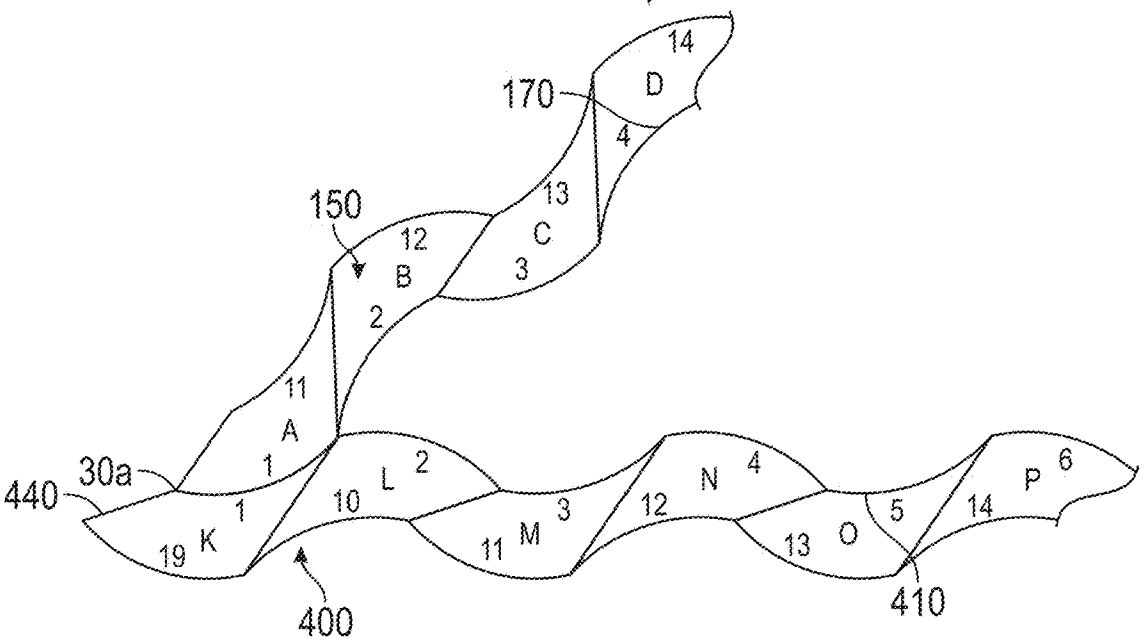
Figure 9:
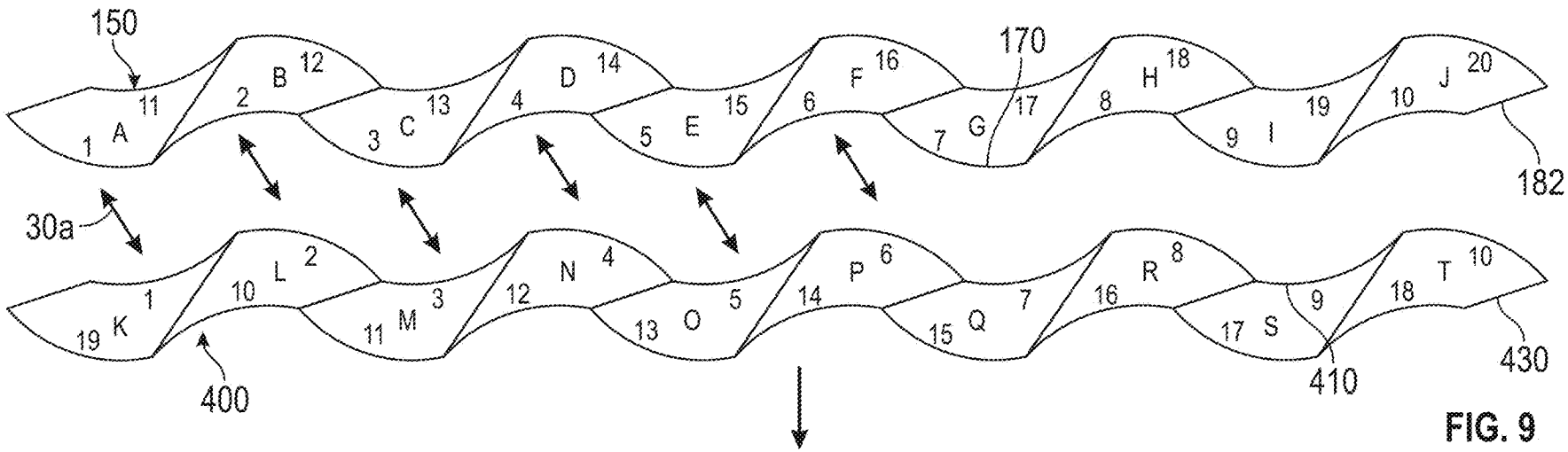
Figure 10:
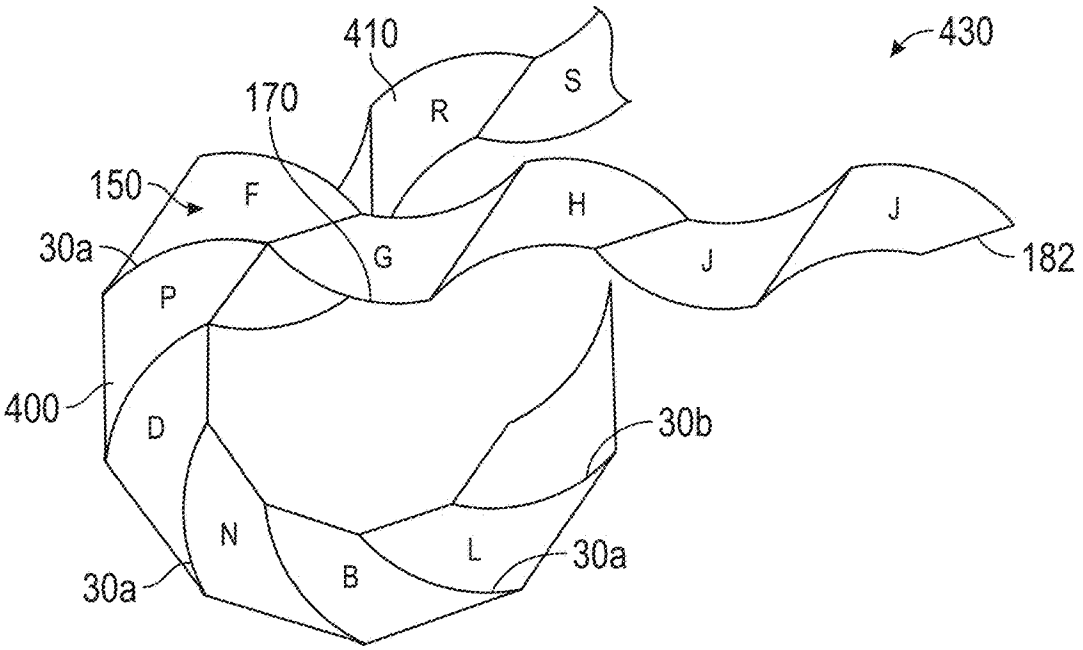

For example, as illustrated in FIGS. 7 and 8 show the first panel 150 and the second panel 400. The first elongated seam 30*a* may start at first panel bottom edge 170 next to the first panel tail edge 184 and the second panel top edge 410 next to the second panel tail edge 440. FIGS. 9 and 10 also show the first panel 150 and the second panel 400. The first elongated seam 30*a* is further applied between the first panel bottom edge 170 and the second panel top edge 410 until reaching the first panel tip edge 182 and the second panel tip edge 430. Once the first elongated seam is completed, the first panel top edge 160 is welded to the second panel bottom edge 420 starting from joining the first segment tail portion top edge 346 and a portion of the bottom edge of the segment 260 adjacent to first segment tip portion's bottom edge 344. The second elongated seam 30*b* is continued till the top edge of panel 150 adjacent to the tip 182 is welded to the bottom edge of panel 400 adjacent to the tail segment 440.

Once the two elongated seams are completely applied, the first panel tip edge 182 and the second panel tip edge 430 are respectively welded to the first panel tail edge 184 and the second panel tail edge 440. These welds seal the life raft 5.

Figure 11:
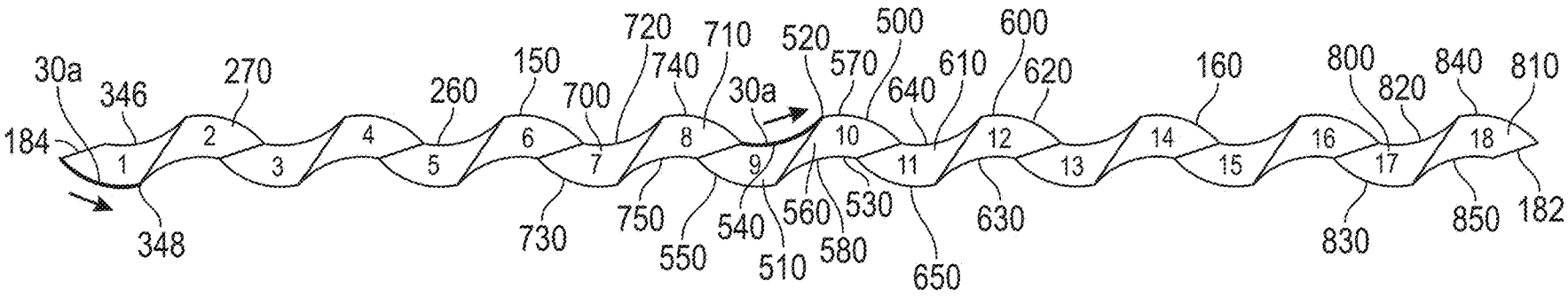
FIGS. 11-12 show the first panel that forms the buoyancy tube for a life raft according to another embodiment.

Turning to FIG. 11, according to an embodiment, (n) is an odd number, such as nine (9) and (n) segments are formed in the first panel 150. The first panel 150 is otherwise the same as disclosed above. The first plurality of segments 260 includes an intermediate segment 500 that is ((n−1)/2) segments spaced apart from the first segment 270. For example, with n being nine (9), the intermediate segment 500 is four (4) segments spaced apart from the first segment 270.

As indicated, the first plurality of segments 260 have a same shape as one another. Thus, the intermediate segment 500 includes, for example, an intermediate segment tail portion 510, an intermediate segment top edge 520 and an intermediate segment bottom edge 530. Further, the intermediate segment tail portion 510 includes an intermediate segment tail portion top edge 540 and the intermediate segment tail portion bottom edge 550. The intermediate segment 500 includes an intermediate segment tip portion 560, that includes an intermediate segment tip portion top edge 570 and an intermediate segment tip portion bottom edge 580.

The plurality of segments includes a tip-adjacent segment 600 that is adjacent, on the tip side, to the intermediate segment 500. The tip-adjacent segment 600 includes, for example, a tip-adjacent segment tail portion 610, a tip-adjacent segment top edge 620 and a tip-adjacent segment bottom edge 630. Further, the tip-adjacent segment tail portion 610 includes the tip-adjacent segment tail portion top edge 640 and a tip-adjacent segment tail portion bottom edge 650.

The plurality of segments includes a tail-adjacent segment 700 that is adjacent, on the tail side, to the intermediate segment 500. The tail-adjacent segment 700 includes, for example, a tail-adjacent segment tip portion 710, a tail-adjacent segment top edge 720 and a tail-adjacent segment bottom edge 730. Further, the tail-adjacent segment tip portion 710 includes the tail-adjacent segment tip portion top edge 740 and a tail-adjacent segment tip portion bottom edge 750.

The plurality of segments includes a tip segment 800, which is the n-th segment, located at the first panel tip edge 182. The tip segment 800 includes, for example, a tip segment tip portion 810, a tip segment top edge 820 and a tip segment bottom edge 830. Further, the tip segment tip portion 810 includes the tip segment tip portion top edge 840 and a tip segment tip portion bottom edge 850.

Figure 12:
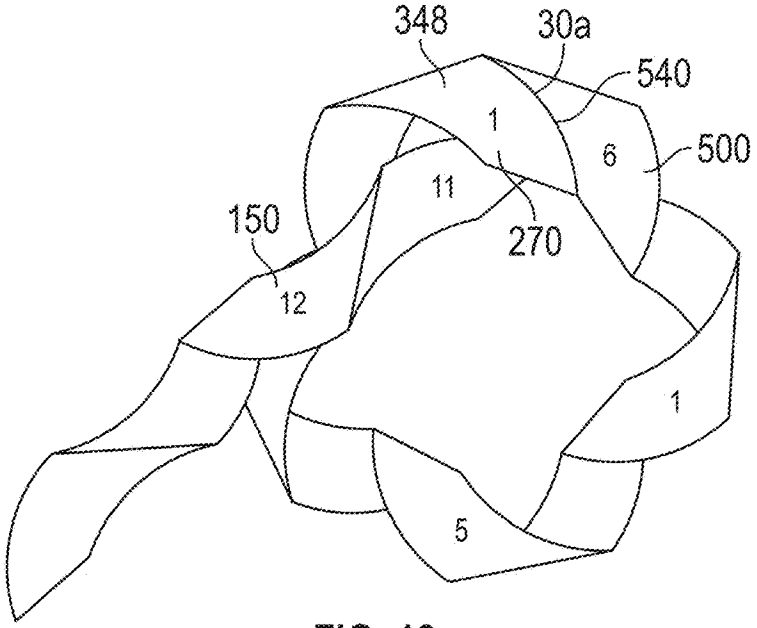

According to an embodiment the life raft 5 is configured so that the first panel 150 is welded upon itself with the elongated seams 30*a*, 30*b*, which, as indicated, are non-overlapping with one another. As illustrated in both FIGS. 11 and 12, the first elongated seam 30*a* connects the first segment tail portion bottom edge 348 with the intermediate segment tail portion top edge 540 after the panel between tail segment and intermediate segment is twisted for (n−1) times as shown in FIG. 12. The first elongated seam 30*a* extends along the first panel top edge 160 until the intermediate segment tip portion bottom edge 580 connects with the tip segment tip portion top edge 840. In this configuration, the life raft 5, while incompletely sealed, takes the form of the toroidal polygon.

Figure 13:
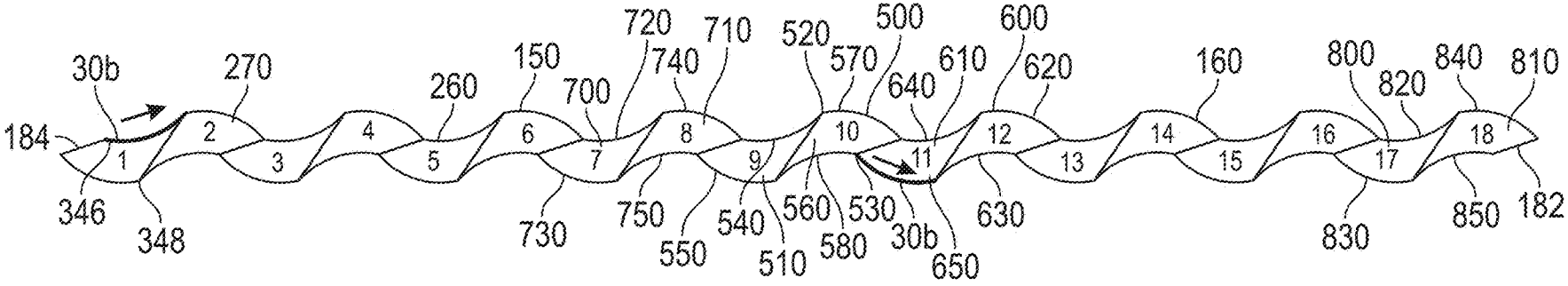
FIGS. 13-15 show additional details of forming the buoyancy tube for a life raft with the first panel according to the other embodiment.
Figure 14:
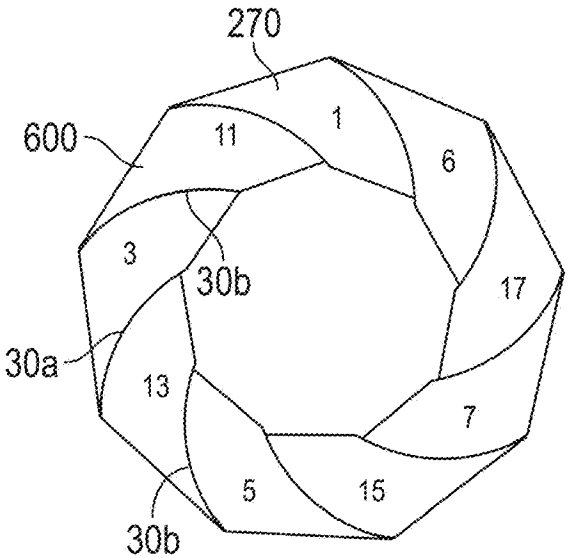
Figure 15:
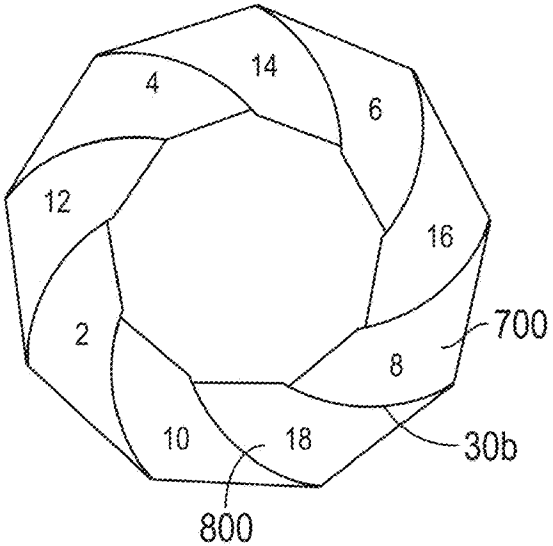

Then as illustrated in FIGS. 13 and 14, the second elongated seam 30*b* connects the first segment tail portion top edge 346 with the tip-adjacent segment tail portion bottom edge 650. As shown in FIGS. 13 and 15, the second elongated seam 30*b* extends along the first panel top edge 160 until connecting the intermediate tail segment's adjacent segment tip portion top edge 740 with the tip segment tip portion bottom edge 850. The first panel tip edge 182 is then welded to the first panel tail edge 184. This seals the life raft 5.

Figure 16:
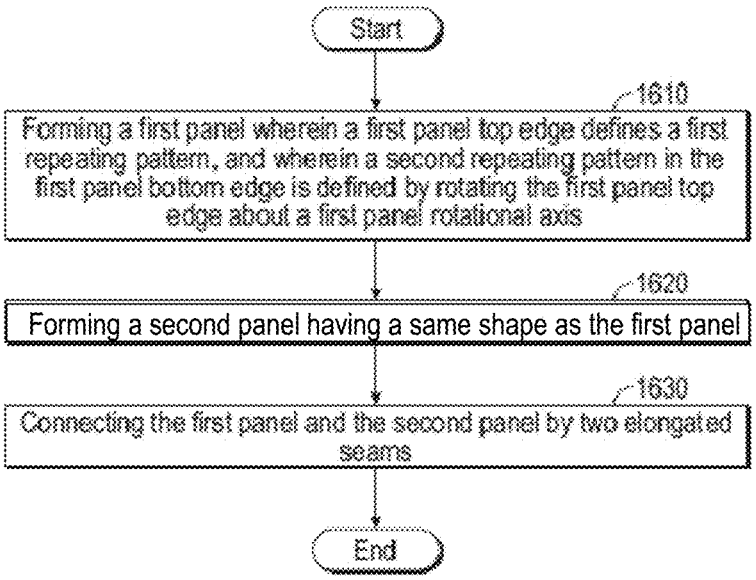
FIG. 16 is a flowchart showing a method of forming a buoyancy tube for a life raft according to an embodiment.

Tuning to FIG. 16, a flowchart shows a method of forming a life raft 5 with an even number of sides. As shown in block 1610, the method includes forming a first panel 150 wherein a first panel top edge 160 defines a first repeating pattern 220, and wherein a second repeating pattern 230 in the first panel bottom edge 170 is defined by rotating the first panel top edge 160 about a first panel rotational axis 240. As shown in block 1620 the method further includes forming the second panel 400 having the above characteristics. For example, the first panel 150 and the second panel 400 have a same shape as one another.

As shown in block 1630 the method further includes connecting the first panel 150 and the second panel along the elongated seams 30*a*, 30*b*. The first elongated seam 30*a* connects the first panel bottom edge 170 and the second panel top edge 410 from the first panel tip edge 182 to the first panel tail edge 184. The second elongated seam 30*b* connects the first panel top edge 160 and the second panel bottom edge 420 from the first panel tip edge 182 to the first panel tail edge 184.

Figure 17:
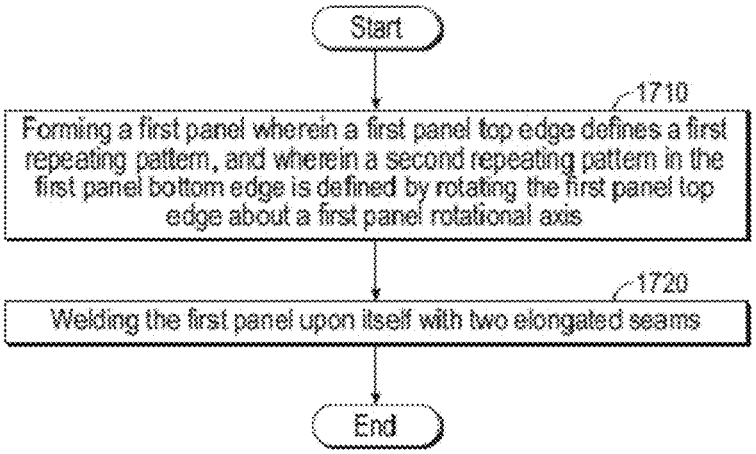
FIG. 17 is a flowchart showing a method of forming a buoyancy tube for a life raft according to another embodiment.

FIG. 17 is a flowchart showing another method of forming a life raft 5 with an odd number of sides. As shown in block 1710 the method includes forming a first panel 150 wherein a first panel top edge 160 defines a first repeating pattern 220, and wherein a second repeating pattern 230 in the first panel bottom edge 170 is defined by rotating the first panel top edge 160 about a first panel rotational axis 240.

As shown in block 1720 the method further includes welding the first panel 150 upon itself along the elongated seams 30*a*, 30*b*. The first elongated seam 30*a* of the two elongated seams 30*a*, 30*b* connects the first panel bottom edge 170, adjacent to the first panel tail edge 184, with the first panel top edge 160, intermediate of the first panel tail edge 184 and the first panel tip edge 182. The first elongated seam 30*a* extends continuously between the first panel top edge 160 and the first panel bottom edge 170 to the first panel tip edge 182. The second elongated seam 30*b* of the two elongated seams 30*a*, 30*b* connects the first panel top edge 160, adjacent to the first panel tail edge 184, with the first panel bottom edge 170, intermediate of the first panel tail edge 184 and the first panel tip edge 182. The second elongated seam 30*b* extends continuously between the first panel top edge 160 and the first panel bottom edge 170 to the first panel tip edge 182.

More specifically, the first elongated seam 30*a* connects the first segment tail portion bottom edge 348 with the intermediate segment tail portion top edge 540. The first elongated seam 30*a* extends along the first panel top edge 160 until the intermediate segment tip portion bottom edge 580 connects with the tip segment tip portion top edge 840. The second elongated seam 30*b* connects the first segment tail portion top edge 346 with the tip-adjacent segment tail portion bottom edge 650. The second elongated seam 30*b* extends along the first panel top edge 160 until connecting the tail-adjacent segment tip portion top edge 740 with the tip segment tip portion bottom edge 850. The first panel tip edge 182 is then welded to the first panel tail edge 184. This seals the life raft 5.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A buoyancy tube for a life raft, comprising:

a first panel including:

a first panel top edge;

a first panel bottom edge spaced apart the first panel top edge such that a first panel transverse axis is defined between the first panel top edge and the first panel bottom edge, wherein the first panel top edge is non-linear and defines a first repeating pattern, and the first panel bottom edge defines a second repeating pattern that is a rotated version of the first panel top edge about a first panel rotational axis;

a first panel tip edge; and a first panel tail edge apart from first panel tip edge such that a first panel longitudinal axis perpendicular to the first panel transverse axis is defined between the first panel tip edge and the first panel tail edge;

a second panel that has a same shape as the first panel, whereby the second panel includes: a second panel top edge; a second panel bottom edge; a second panel tip edge; and a second panel tail edge, wherein the first panel and the second panel are connected by a first elongated seam and a second elongated seam that are non-overlapping with one another, wherein the first elongated seam connects the first panel bottom edge and the second panel top edge, from the first panel tip edge to the first panel tail edge, and the second elongated seam connects the first panel top edge and the second panel bottom edge, from the first panel tip edge to the first panel tail edge, and wherein the first panel and second panel, when connected, define outer and inner boundaries of the life raft, the outer boundary defines an outer polygon having a plurality of outer sides and the inner boundary defining an inner polygon having a plurality of inner sides such that each of the plurality of outer sides is parallel with one of the plurality of inner sides.

2. The buoyancy tube of claim 1, wherein:

the plurality of outer sides includes a first outer side extending from a first end to a second end;

the plurality of inner sides includes a first inner side extending from a third end to a fourth end, wherein the first outer side and the first inner side are parallel to one another;

the plurality of inner sides includes a second inner side that extends from a fifth end to the third end, wherein the second inner side is circumferentially adjacent to the first inner side;

a first seam portion of a first elongated seam extends from the first end to the fifth end, between the outer polygon and the inner polygon;

a second seam portion of a second elongated seam extends from the second end to the third end, between the outer polygon and the inner polygon; and the first elongated seam and the second elongated seam extend a plurality of times around the life raft.

3. The buoyancy tube of claim 2, wherein:

a first leg of a quadrilateral is defined by the first outer side;

a second leg of the quadrilateral is defined by the first seam portion;

a third leg of the quadrilateral is defined by a second elongated seam portion; and a fourth leg of the quadrilateral is defined by the second inner side.

4. The buoyancy tube of claim 3, wherein:

the quadrilateral defines a first normal axis extending from the third end through a point on the first leg of the quadrilateral, wherein the first normal axis is normal to the first leg of the quadrilateral;

a normal axis segment extends along the first normal axis, between the third end and the point on the first leg of the quadrilateral;

a second normal axis is normal to the first normal axis and extends from the third end; and an obtuse angle is defined between the second normal axis and the fourth leg of the quadrilateral.

5. The buoyancy tube of claim 4, wherein:

the plurality of outer sides and the plurality of inner sides each comprise (n) sides;

a length of the normal axis segment is $(Do-Di)\times n/4$, wherein (Do) is a diameter formed by outer edges of the outer polygon, and (Di) is a diameter formed by outer edges of the inner polygon;

the obtuse angle is (180−(360/n)), measured in degrees;

a length of the first leg of the quadrilateral is Do*sin(360/(2n)); and a length of the fourth leg of the quadrilateral, defined by the second inner side of the plurality of inner sides, is Di*sin(360/(2n)).

6. The buoyancy tube of claim 5, wherein:

the second leg and the third leg of the quadrilateral formed by the second seam portion are each formed along a curve defined by y=Ax^2+0.8x.

7. The buoyancy tube of claim 6, wherein:

the first panel includes a first plurality of segments, wherein each of the first plurality of segments has a same shape as one another; and the first plurality of segments are connected to one another in series.

8. The buoyancy tube of claim 7, wherein:

a first segment of the first plurality of segments includes a first segment tip edge, a first segment tail edge, a first segment top edge and a first segment bottom edge; the first segment is divided by a first segment linear joint extending between the first segment top edge and the first segment bottom edge, defining into a first segment tip portion and a first segment tail portion;

the first segment tip portion includes: the first segment tip edge; a first segment tip portion top edge; and a first segment tip portion bottom edge;

the first segment tail portion includes: the first segment tail edge; a first segment tail portion top edge; and a first segment tail portion bottom edge;

the first segment tip portion is a rotated version of the first segment tail portion about a first segment rotation axis; and the first leg of the quadrilateral is formed along the first segment linear joint; the second leg of the quadrilateral is formed along the first segment tail portion bottom edge; the third leg of the quadrilateral is formed by the first segment tail portion top edge and the fourth leg of the quadrilateral is formed by the first panel tail edge.

9. A method of forming a buoyancy tube for a life raft, comprising:

forming a first panel wherein a first panel top edge is non-linear and defines a first repeating pattern, and wherein a second repeating pattern in a first panel bottom edge is defined by rotating the first panel top edge about a first panel rotational axis;

forming a second panel, wherein the first panel and the second panel have a same shape as one another; and connecting the first panel and the second panel by two elongated seams, wherein one of the two elongated seams connects the first panel bottom edge and a second panel top edge from a first panel tip edge to a first panel tail edge, and another of the two elongated seams connects the first panel top edge and a second panel bottom edge from the first panel tip edge to the first panel tail edge.

* * * * *